United States Patent [19]

Upmeier et al.

[11] 4,223,617

[45] Sep. 23, 1980

[54] LOOPTAKER ARRANGEMENT IN SEWING DEVICES

[75] Inventors: Egon Upmeier, Lage; Günter Hagemeyer, Leopoldshöhe, both of Fed. Rep. of Germany

[73] Assignee: Kochs Adler AG, Bielefeld, Fed. Rep. of Germany

[21] Appl. No.: 16,922

[22] Filed: Mar. 2, 1979

[51] Int. Cl.[2] ..... D05B 57/30

[52] U.S. Cl. ..... 112/184; 112/186; 112/311; 112/121.12

[58] Field of Search ..... 112/193, 181, 184, 165, 112/166, 202, 311, 121.12, 121.15, 191, 228, 231, 197, 186, 199, 200, 180, 182, 118

[56] References Cited

U.S. PATENT DOCUMENTS

| | | | |
|---|---|---|---|
| 862,033 | 7/1907 | Toof | 112/186 |
| 2,671,420 | 3/1954 | Backlin | 112/231 X |
| 3,170,423 | 2/1965 | Henebry | 112/118 X |
| 3,374,755 | 3/1968 | Chaplin, Jr. | 112/184 |
| 3,807,331 | 4/1974 | Simpson | 112/186 |
| 3,867,891 | 2/1975 | Grabber | 112/166 |
| 3,974,787 | 8/1976 | Kraatz et al. | 112/311 X |
| 4,091,754 | 5/1978 | Onembo | 112/200 |
| 4,121,527 | 10/1978 | Johnson | 112/184 X |

*Primary Examiner*—Werner H. Schroeder
*Assistant Examiner*—Andrew M. Falik
*Attorney, Agent, or Firm*—Max Fogiel

[57] ABSTRACT

In a sewing device for sewing fabric cuts on workpiece parts, which are moved by means of a workpiece clamping plate relatively to the needle of a sewing machine, a tiltably arranged and easily accessible vertical axis rotary looptaker for allowing replenishment of thread supply.

5 Claims, 9 Drawing Figures

Fig. 3
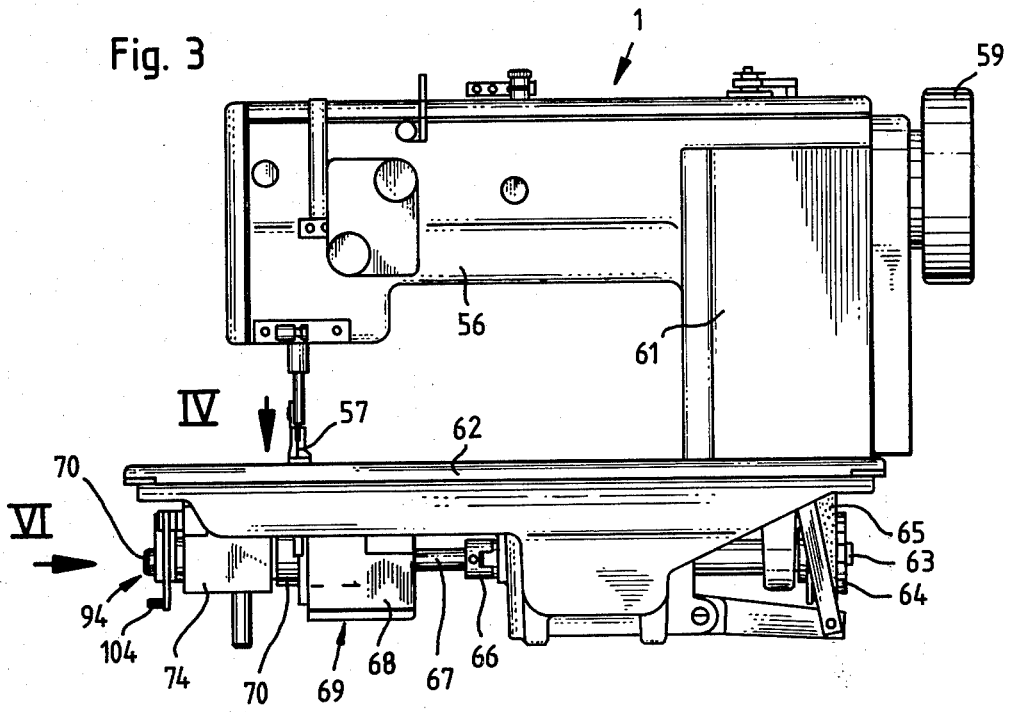
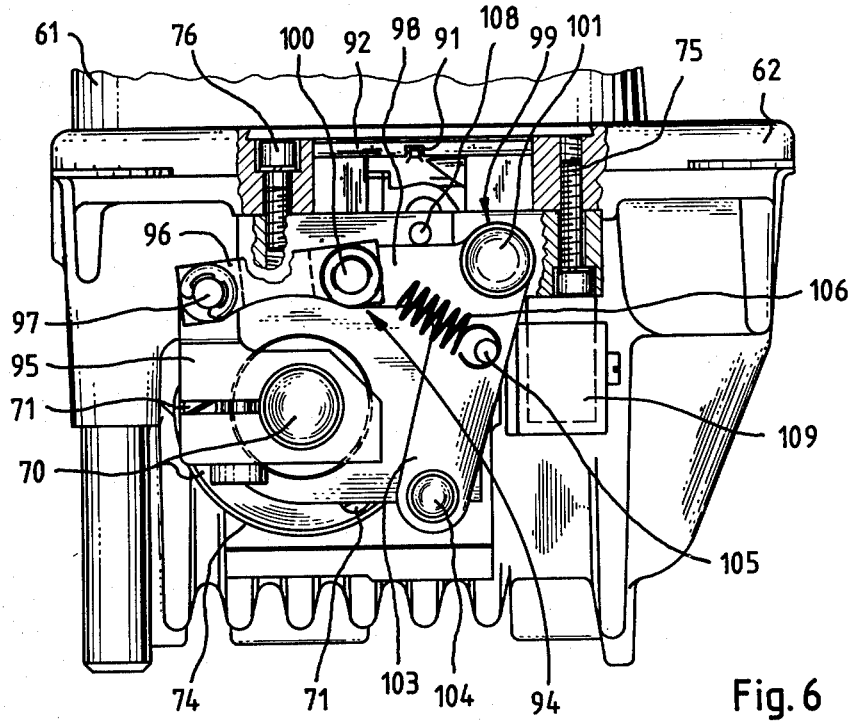
Fig. 6

Fig. 4
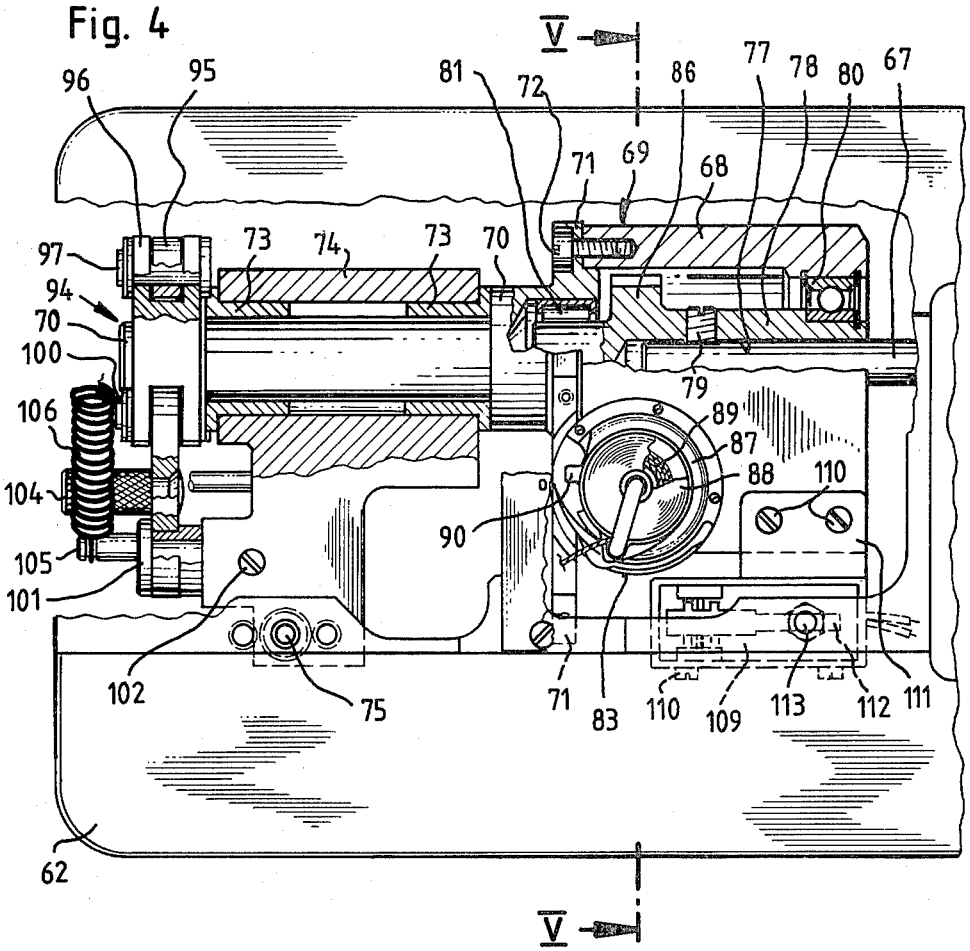
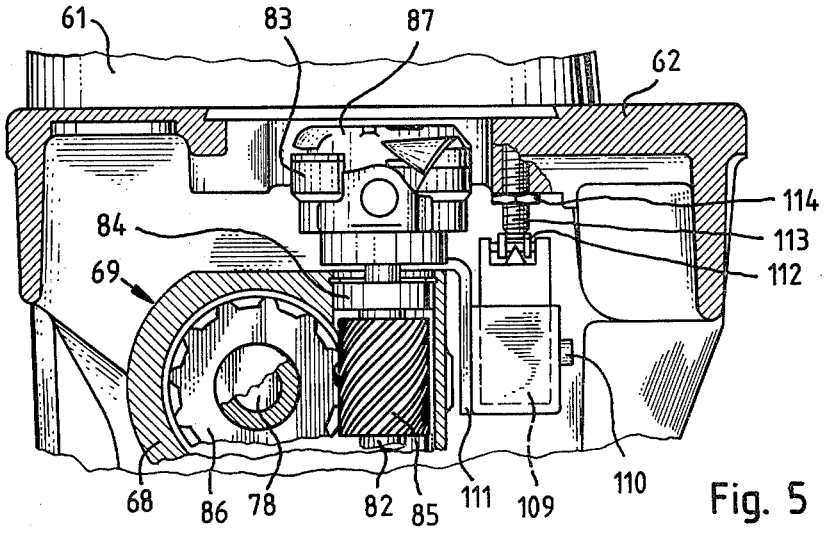
Fig. 5

Fig. 7
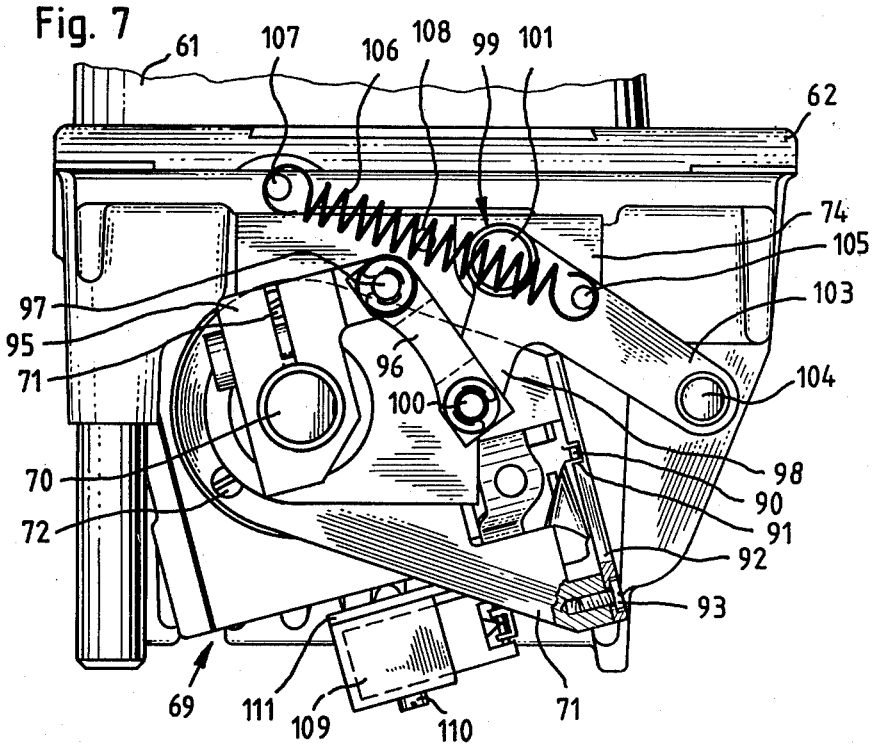
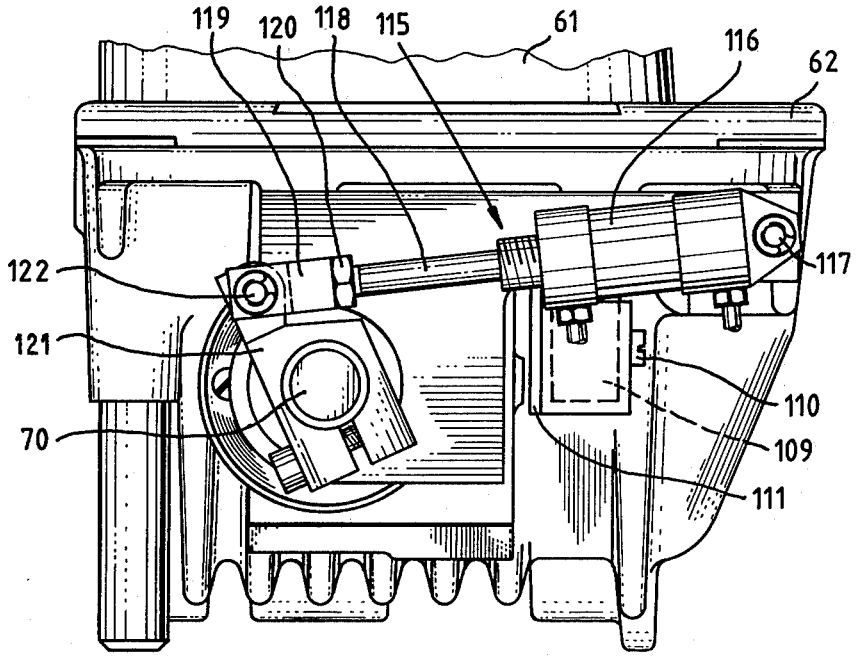
Fig. 8

LOOPTAKER ARRANGEMENT IN SEWING DEVICES

BACKGROUND OF THE INVENTION

The invention relates to a special arrangement of a vertical axis rotary looptaker for readily replenishing the thread supply of a double lockstitch sewing machine, which is a part of an automated sewing device.

Sewing devices for sewing a fabric cut on a workpiece part by means of two parallelly extending stitchlines, which are received in a controlled workpiece clamping plate, commonly are provided with a double-needle sewing machine having two vertical axis rotary looptakers carrying a thread supply. In order to replenish the thread supply, the operator must clear the table, i.e. removing the workpiece respectively transferring a clamped workpiece by means of the feeding unit into a position as not to interfer with the thread supply replenishing procedure. Additionally, the operator must remove the slide plates covering the looptakers.

To indicate a required bobbin change sewing devices of this type are equipped with workpiece counters. Nevertheless, it occurs, that the looptaker thread supply is consumed before the workpiece is finished. In such case, the process of thread supply replenishment becomes even more difficult, since the operator must trigger the built-in thread trimmer to disconnect the needle thread from the partially sewn workpiece prior to removing the workpiece.

As obvious, the thread replenishing procedure is a time consuming process. Furthermore, a special control mechanism is necessary to displace the workpiece clamp as the sewing machine remains inoperative, in order to clear the looptakers. Moreover, the sliding of a partially sewn and even cut workpiece by the workpiece clamp on a workplate presents a problem, since the workpiece parts tend to move relatively to each other.

In the production of setting patch pockets on garments similar automated sewing devices have been applied. Such a sewing device in general is installed with a single-needle double lockstitch machine, which has a horizontal axis rotary looptaker. For this reason, independently of the workpiece clamp position, the looptaker always is easily accessible for thread supply replenishment.

SUMMARY OF THE INVENTION

It is an object of this invention to find an arrangement of a vertical axis rotary looptaker installed in a sewing machine of a sewing device as aforesaid, which allows an easy access to the looptaker for replenishing the thread supply in a short time.

It is another object of this invention to avoid a displacement of a workpiece feeding unit in order to replenish the looptaker thread supply.

A further object of the present invention is to provide a sewing device, which has a plane work table without any edges or recesses besides the stitch hole, causing an increase of friction and distorting the workpieces moved by the feeding unit on the work table.

The foregoing is realised by arranging the vertical axis rotary looptaker of a sewing device in a tiltable manner. In a preferred embodiment the saddle, which carries the looptaker, is shifted and locked by a shifting mechanism.

Other objects, features and advantages of the invention will be described in connection with the drawings and appended claims.

BRIEF DESCRIPTION OF THE DRAWINGS

FIG. 3 is an enlarged front elevation of the sewing machine illustrated in FIGS. 1 and 2;

FIG. 4 is an enlarged view of the sewing machine, partially broken away, in direction IV of FIG. 3;

FIG. 5 is a section taken along line V—V of FIG. 4;

FIG. 6 is a side view of the sewing machine, partially broken away, in the direction VI of FIG. 3;

FIG. 7 is a side view of the sewing machine as FIG. 6, however showing the saddle with the looptaker in a tilted position; and FIG. 8 shows a view similar to FIG. 6, however with another saddle-shifting mechanism.

DESCRIPTION OF THE PREFERRED EMBODIMENT

Figure 1:
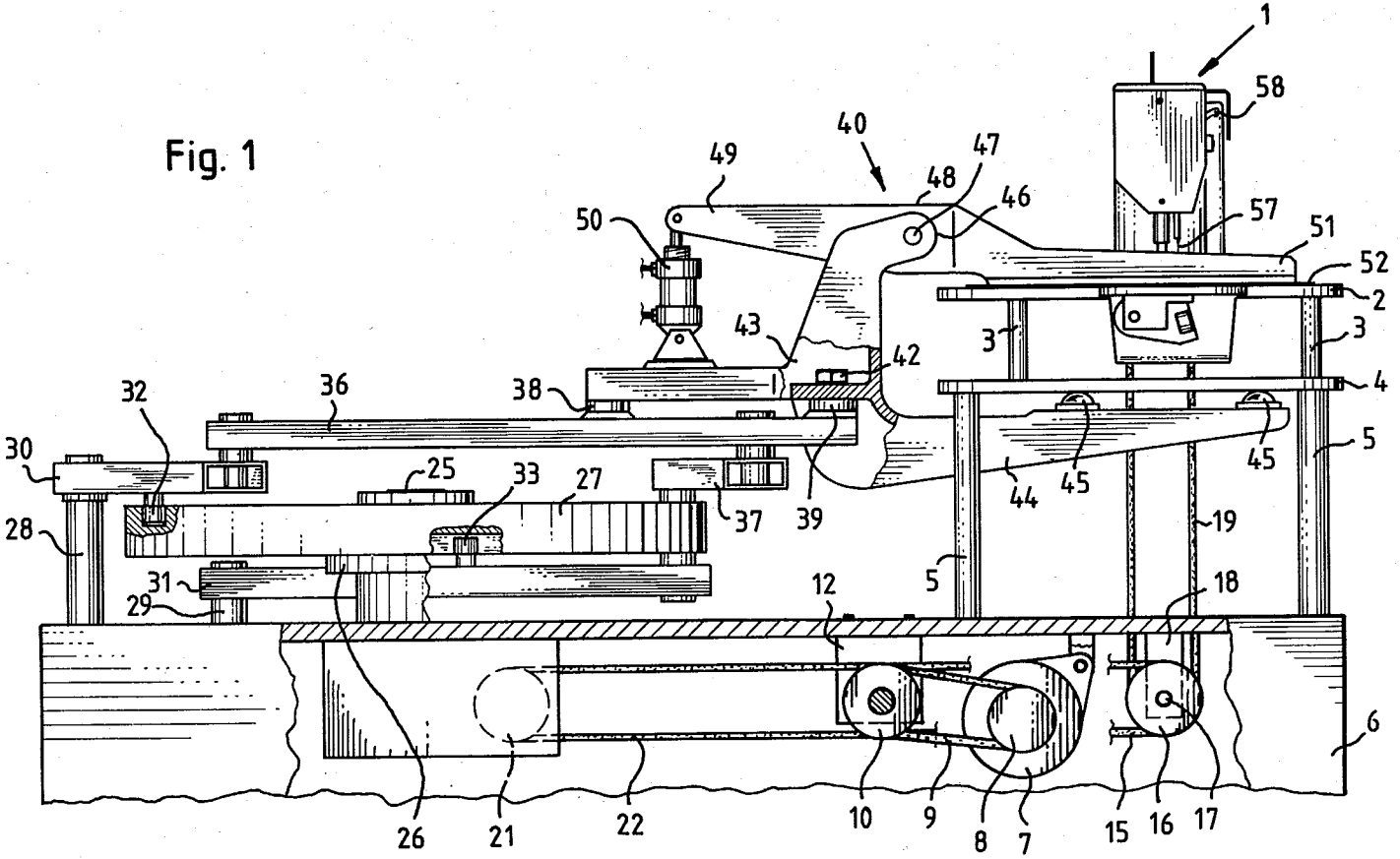
FIG. 1 is a side view of the sewing device including a sewing machine incorporating the present invention.
Figure 2:
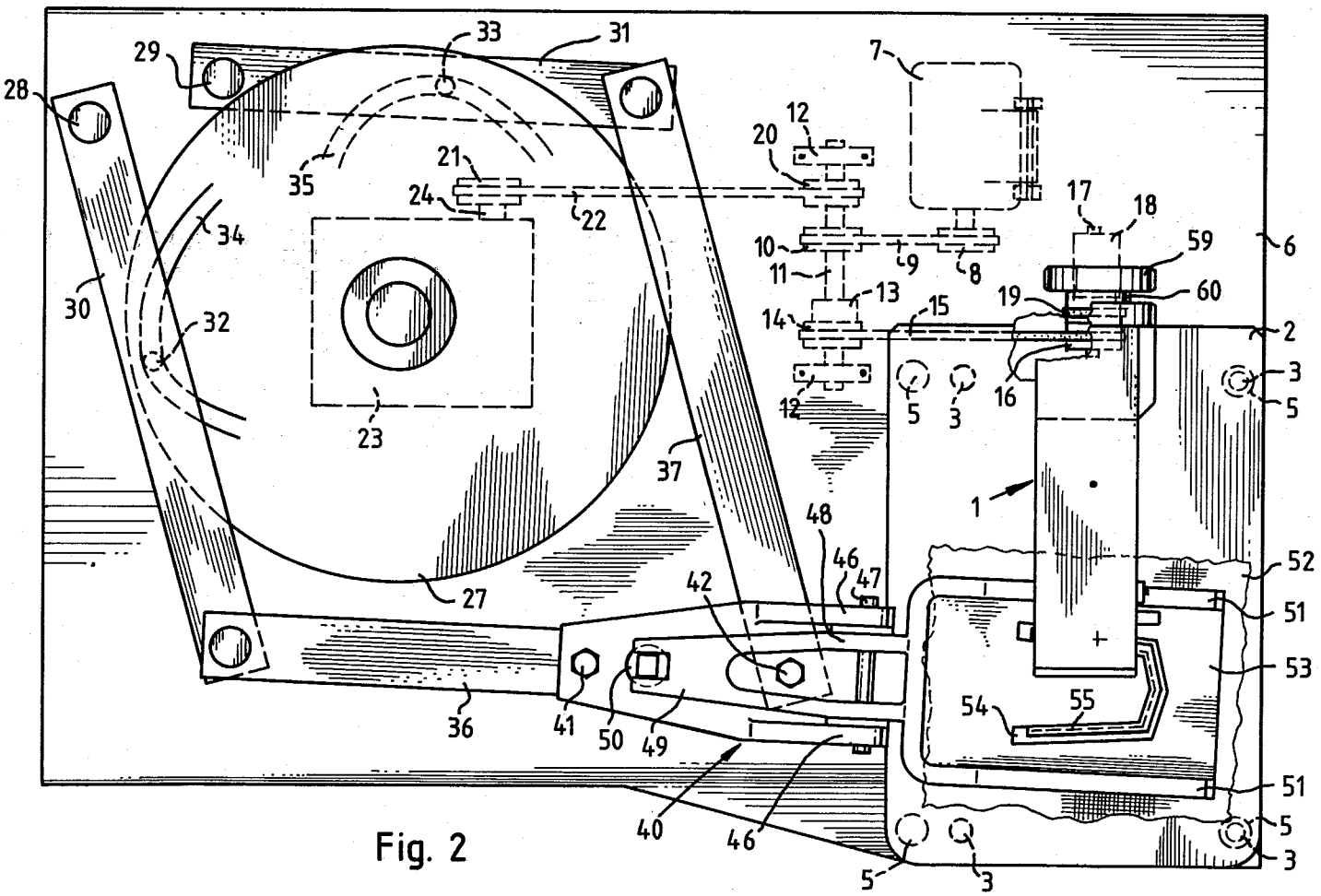
FIG. 2 is a top plan view of the sewing device corresponding to FIG. 1.

Referring more particular to the drawings, a sewing machine 1 is received on a work supporting plate 2 fastened by means of studs 3 to a plate 4, which is mounted on posts 5 arranged on a stand 6 (FIG. 1). The stand 6 is provided with a motor 7 having a pulley 8 for driving a pulley 10 by means of a belt 9. The pulley 10 is secured to a transmission shaft 11 received in bearings 12, which are fastened to the stand 6. As illustrated in FIGS. 1 and 2, the transmission shaft 11 carries a clutch coupling 13, which is provided with a pulley 14 for driving by means of a belt 15 an intermediate pulley 16 arranged on a shaft 17, which is received in a bearing 18 fastened to the stand 6, in order to drive the sewing machine 1 via a belt 19. The transmission shaft 11 further carries a pulley 20 cooperating with a pulley 21 by means of a belt 22.

A reduction gear 23 has an input shaft 24 for the pulley 21 and is fastened to the stand 6. The reduction gear 23 further has a vertical output shaft 25, which is provided with a flange 26 for receiving a control disk 27.

The stand 6 is further provided with bearings 28 and 29, which pivotally receive the ends of levers 30 and 31, each having a cam follower 32 and 33 for cooperating with cam grooves 34 and 35, which are located in the control disk 27. The free end of the lever 30 is linked to one end 35 of a drive lever 36, whereas the free end of the lever 31 is hinged to a connecting lever 37, the free end of which is linked to the drive lever 36.

Furthermore, the drive lever 36 is provided with studs 38 and 39 for carrying a workpiece clamping mechanism 40 by means of screws 41 and 42. The workpiece clamping mechanism 40 consists of a bracket 43 installed with an arm 44 (FIG. 1), which reaches beneath the plate 4 and has thrust bearings 45 abutting against the plate 4, and an upstanding bearing 46 for hingedly receiving a bolt 47 supporting a double-armed lever 48, one arm 49 of which is linked to a pneumatic cylinder 50 jointly resting on the bracket 43, whereas the other arm 51 of which rests against the workpiece supporting plate 2 clamping a workpiece 52. The other arm 51 is further provided with a plate 53, which has a recess 54 shaped according to the configuration of a stitch pattern 55 to perform stitching (FIG. 2).

As illustrated in FIG. 3, the sewing machine 1 has a bracket arm 56 receiving an arm shaft (not shown) for driving a needle 57 and a thread take-up lever 58 (FIG. 1). The arm shaft carries a handwheel 59 installed with a pulley 60 for the aforesaid belt 19 (FIG. 2). The bracket arm 56 is connected with a standard 61 mounted on a bed 62, in which a shaft 63 is pivoted. The shaft 63 has a pulley 64 and is driven via a timing belt 65 by means of the non-illustrated arm shaft. Furthermore, the shaft 63 is coupled by means of a coupling 66 to a horizontal shaft 67 pivoted in a housing 68 of a saddle 69 (FIG. 3). Concentrically to the horizontal shaft 67 a cylindrical stud 70 having a flange 71, is fastened to the housing 68 by screws 72. The stud 70 is pivoted in bushings 73 arranged in a bracket 74 fastened by screws 75 and 76 to the bed 62 (FIGS. 4,6 and 7). The horizontal shaft 67 ends in an axial bore 77 of a shaft 78 and is fastened by a set screw 79 (FIG. 4). The shaft 78 has a spiral gear 86 and is pivoted in the saddle 69 by a ball bearing 80 arranged in the housing 68 and a needle bearing 81 received in the cylindrical stud 70. According to FIG. 5 a vertical shaft 82 carrying a rotary looptaker 83 is provided with a spiral gear 85 cooperating with the spiral gear 86 and is journaled in bearings 84 received in the saddle 69. Journaled in the rotary looptaker 83 is a bobbin case 87, in which a bobbin 88 with a thread supply 89 is received (FIG. 4). The bobbin case 87 is shaped with a radially extending nose 90 entering a stop notch 91 formed in a bridging bar 92, which is fastened by screws 93 to the flange 71 (FIG. 7), in order to prevent the bobbin case 87 from rotation.

For the purpose of positioning the tiltably arranged saddle 69 is installed with a shifting mechanism 94 (FIGS. 4 and 6). On the cylindrical stud 70 there is clamped a lever 95, the free end of which is linked to an intermediate lever 96 by a bolt 97. The other end of the intermediate lever 96 is hingedly connected to one arm 98 of an angle lever 99 by a bolt 100. The angle lever 99 is pivoted on a bolt 101 fastened by a set screw 102 to the bracket 74. The free arm 103 of the angle lever 99 is provided with a handle 104 and a pin 105, on which a tension spring 106 acts. The free end of the tension spring 106 is connected to a pin 107 arranged in the bed 62 (FIG. 7). For limiting the movement of the angle lever 99 the bracket 74 is provided with a pin 108.

Furthermore, the saddle 69 is equipped with an electrical switch 109, which is fastened by means of screws 110 and a bracket 111. The electrical switch 109 has an actuating lever 112, which cooperates with a threaded stud 113 secured to the bed 62 by a lock nut 114 (FIGS. 4 and 5).

Referring to FIG. 8, in a modified shifting mechanism 115 a pneumatic cylinder 116 is hingedly received on a bolt 117 arranged in the bed 62. On the piston rod 118 there is fastened a forked part 119 secured by a lock nut 120. The forked part 119 is linked to an actuating lever 121 by means of a bolt 122, wherein the actuating lever 121 is clamped on the cylindrical stud 70 similar as in the above described shifting mechanism 94 (FIG. 6).

Figure 9:
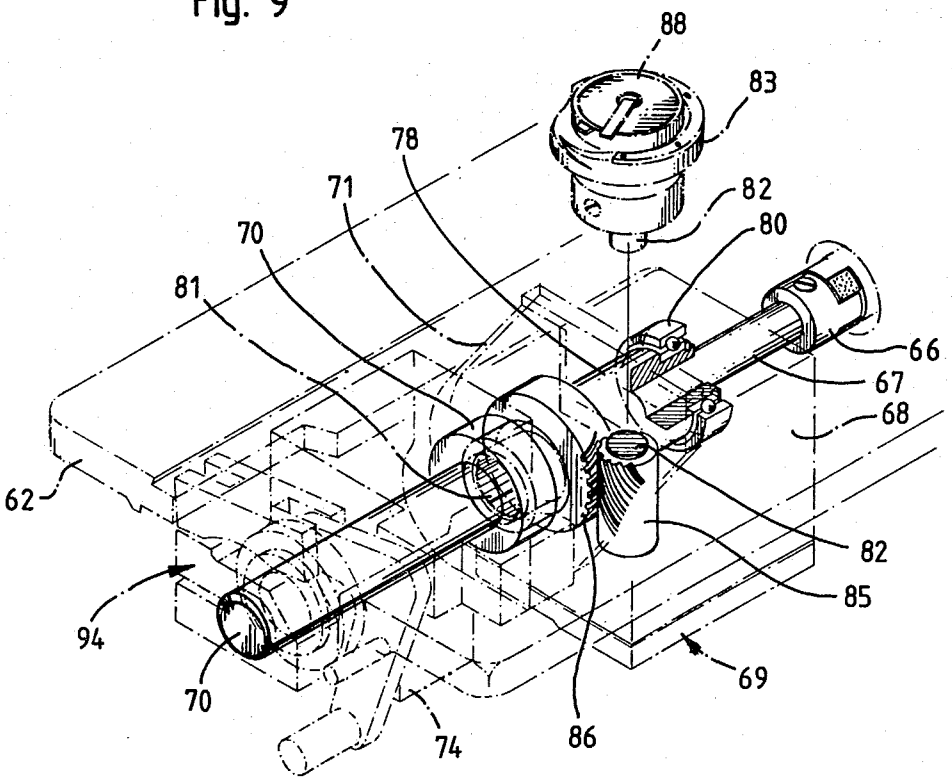
FIG. 9 partially shows the bed of the sewing machine with the looptaker arrangement in a transparent perspective view.

The total construction of the looptaker arrangement may be best seen from FIG. 9. According to this illustration, the drive motion is transferred from the horizontal shaft 67 to the shaft 78, the spiral gear 86 of which cooperates with the spiral gear 85 rotating the vertical shaft 82. As above described, both, the vertical shaft 82 and the shaft 78 are pivoted in the saddle 69 thus preventing disengagement as the saddle 69 is tilted about the common axis of the shafts 67, 78 and the cylindrical stud 70.

Operation of the present invention can be described as follows:

In sewing condition the saddle 69 is kept in a sewing position, as illustrated in FIGS. 5 and 6, by the shifting mechanism 94 respectively 115. In sewing position the rotary looptaker 83 cooperates with the needle 57 in order to perform stitching. As obvious from FIG. 6, the shifting mechanism 94 firmly locks the saddle 69 via the cylindrical stud 70 in sewing position and prevents any undesired tilting movements. The shifting mechanism 94 is kept in the locked position by the tension spring 106.

For the purpose of replenishing the thread supply 89, the operator tilts the saddle 69 into an easily accessible position by pulling the arm 103 of the angle lever 99 by means of the handle 104 (FIG. 7). In order to prevent starting of the sewing device while the saddle 69 still is in the tilted position for thread replenishing purpose, the electrical switch 109 performs a control function for the operator.

What we claim is:

1. In a sewing device, comprising a stand, a workpiece supporting plate, workpiece clamping means, and a sewing machine received by said stand having stitch forming means including a looptaker rotatable about a specific axis relative to said clamping means and carrying a bobbin with a thread supply, control means for moving said workpiece clamping means relative to said stitch forming means, means for driving said control means and said looptaker, and means for moving said looptaker away from a sewing position in said axis to an easily accessible position in a different axis without disengaging its connection to said drive means whereby a clamped workpiece remains undisplaced relative to said workpiece supporting plate when said looptaker is replenished with thread supply.

2. A sewing device according to claim 1, wherein said stitch forming means of said sewing machine further include a vertical shaft for receiving said looptaker and transmitting means between said driving means of said sewing machine and said vertical shaft, and said means for carrying said looptaker from a sewing position to an easily accessible position include means for preventing disengagement of said transmitting means when tilting said vertical shaft carrying said looptaker.

3. In a sewing device, comprising a stand, a sewing machine received by said stand and having stitch forming means including a looptaker carrying a thread supply, a workpiece supporting plate, workpiece clamping means, control means for moving said workpiece clamping means relatively to said stitch forming means and means for driving said sewing machine with said looptaker and said control means, means for carrying said looptaker from a sewing position to an easily accessible position in order to allow a replenishment of said looptaker with thread supply, said stitch forming means of said sewing machine further including a vertical shaft for receiving said looptaker and transmitting means between said driving means of said sewing machine and said vertical shaft, and said means for carrying said looptaker from a sewing position to an easily accessible position include means for preventing disengagement of said transmitting means when tilting said vertical shaft carrying said looptaker, said sewing machine further including a horizontal shaft and a saddle for receiving said vertical shaft and said horizontal shaft, and said transmitting means include meshing gears connecting said vertical shaft with said horizontal shaft, and wherein said means for carrying said looptaker from a sewing position to an easily accessible position further comprises means for tilting said saddle with said looptaker about the axis of said horizontal shaft whereby a clamped workpiece remains undisplaced when said looptaker is replenished with thread supply.

4. A sewing device according to claim 3, wherein said means for tilting said saddle comprise a toggle-joint mechanism consisting of an angle lever pivoted to said sewing machine, an intermediate lever linked to one arm of said angle lever and to said saddle, a handle secured to the free arm of said angle lever and a tension spring acting between said sewing machine and said free arm of said angle lever, in order to keep said saddle with said looptaker in a sewing position corresponding to a position which allows replenishment of said looptaker with thread supply.

5. A sewing device for sewing fabric cuts on workpiece parts, comprising a stand, a workpiece supporting plate, workpiece clamping means, a sewing machine, including a needle, a lockstitch looptaker carrying a bobbin, a vertical shaft carrying said looptaker, a horizontal shaft, gear means connecting said vertical shaft and said horizontal shaft and a saddle for receiving said vertical shaft and said horizontal shaft, control means for moving said workpiece clamping means relatively to said needle, means for driving said sewing machine and said control means and means for carrying said looptaker from a sewing position to an easily accessible position in order to allow an exchange of said bobbin, comprising means for tilting said saddle with said looptaker about the axis of said horizontal shaft, consisting of an actuating lever fastened to said saddle and a pneumatic cylinder linked to said actuating lever and said sewing machine whereby a clamped workpiece remains undisplaced when said looptaker is replenished with thread supply.

* * * * *